US005265528A

United States Patent [19]

Mathes

[11] Patent Number: 5,265,528

[45] Date of Patent: Nov. 30, 1993

[54] CLUTCH MECHANISM FOR RELEASING THE GEARS OF A DOUBLE GEARWHEEL DRIVE IN A PRINTING PRESS

[75] Inventor: Josef Mathes, Offenbach am Main, Fed. Rep. of Germany

[73] Assignee: MAN Roland Druckmaschinen AG, Fed. Rep. of Germany

[21] Appl. No.: 992,570

[22] Filed: Dec. 18, 1992

[30] Foreign Application Priority Data

Dec. 18, 1991 [DE] Fed. Rep. of Germany ..... 4141817

[51] Int. Cl.[5] ..... B41F 21/10; B41F 13/12

[52] U.S. Cl. ..... 101/183; 101/230; 192/20

[58] Field of Search ..... 101/230, 231, 248, 183, 101/181, 182, 184, 216, 232; 74/395, 439, 440, 444, 448, 333, 330; 192/20, 21

[56] References Cited

U.S. PATENT DOCUMENTS

| | | | |
|---|---|---|---|
| 3,691,948 | 9/1972 | Southam et al. | 101/183 |
| 4,444,106 | 4/1984 | Frenzel et al. | 101/183 |
| 4,716,827 | 1/1988 | Wieland et al. | 101/216 |
| 5,031,531 | 7/1991 | Becker | 101/230 |

FOREIGN PATENT DOCUMENTS

| | | |
|---|---|---|
| 3127539 | 6/1982 | Fed. Rep. of Germany . |
| 3534488 | 4/1987 | Fed. Rep. of Germany . |
| 3611324 | 12/1988 | Fed. Rep. of Germany . |

*Primary Examiner*—J. Reed Fisher
*Attorney, Agent, or Firm*—Leydig, Voit & Mayer

[57] ABSTRACT

A clutch mechanism for releasing a frictional connection in a double gearwheel drive of a sheet-fed rotary press wherein a gearwheel ring is mounted concentrically on and frictionally connected to a main gearwheel by a spring biased annular clamping element, the clutch including an annular actuator mounted on the press in alignment with but normally out of contact with the annular clamping element and the double gearwheel and means for selectively engaging the actuator with the clamping element and causing relative axial displacement thereof to overcome the spring bias and free the gearwheel ring from frictional engagement with the main gearwheel. The actuator may include an annular fluid pressure cylinder, a camming mechanism or an electromagnet for causing the relative axial displacement of the annular clamping element.

20 Claims, 5 Drawing Sheets

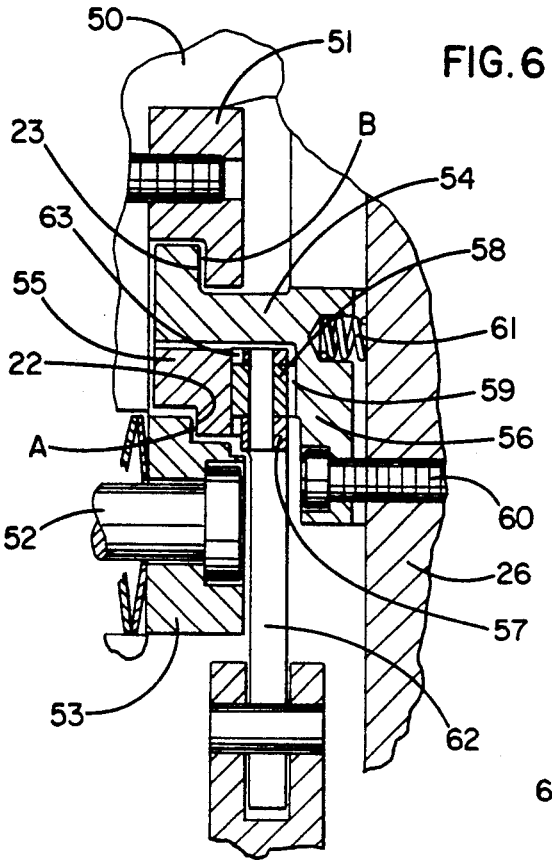
FIG. 6
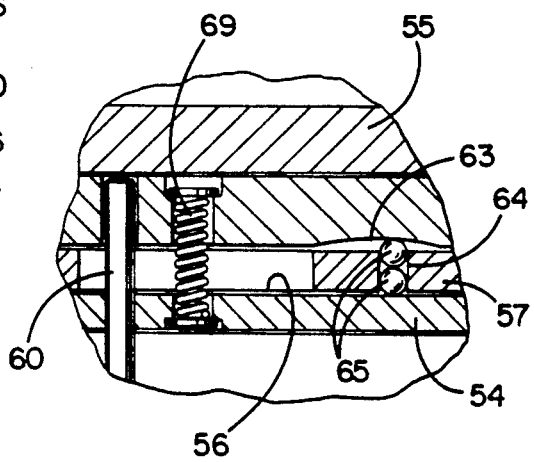
FIG. 6b
FIG. 6a
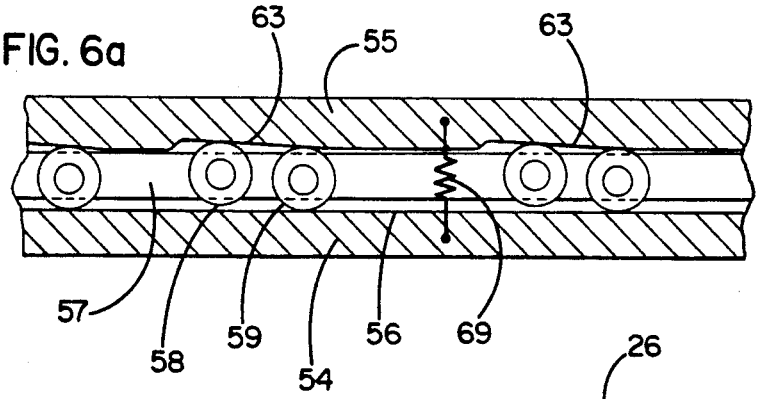
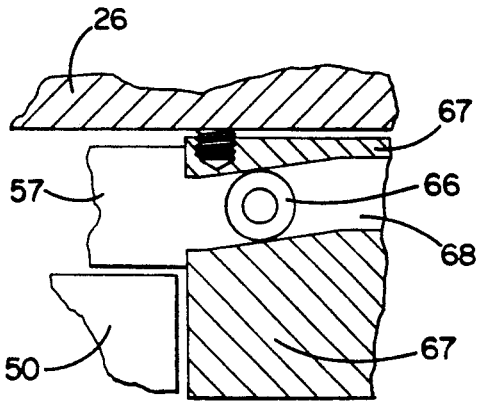
FIG. 6c

CLUTCH MECHANISM FOR RELEASING THE GEARS OF A DOUBLE GEARWHEEL DRIVE IN A PRINTING PRESS

FIELD OF THE INVENTION

The present invention relates generally to clutch mechanisms and more particularly concerns a clutch mechanism for releasing the frictional connection in a double gearwheel drive of a sheet-fed rotary press.

BACKGROUND OF THE INVENTION

In sheet-fed rotary presses, a sheet turnover mechanism is disposed in the sheet transport path in order to turn the sheet over. Normally, the sheet is transported with its front edge leading through the entire machine and only the top of the sheet is printed. If the sheet is to be printed on both sides, the sheet turnover mechanism is switched over between two printing units, as a result of which the trailing edge of the sheet becomes the leading edge. Thus to turn the sheet over, the relative position of the adjacent printing units must be changed so that the trailing edge can now be transferred here instead of the leading edge of the sheet. To change the relative position of the sheet edges, the transmission line in a press of this kind must be capable of being disconnected. Double gearwheels have been known for this purpose for many years. In a double gearwheel of this kind, a gearwheel ring is fitted on a main gearwheel and is frictionally connected to the main gearwheel by a clamping mechanism. Such mechanisms hitherto consisted of clamping shoes or a clamp ring and the clamping elements were individually tensioned manually. In the course of the further development of printing presses, the procedure adopted was to render the clamping mechanisms such that they can be automated in order to avoid tedious manual operation.

A mechanism of the foregoing kind is generally described in DE-PS 35 34 488. In this mechanism for clamping together two gearwheels in a sheet-fed rotary press which can be set from single-sided printing to perfecting printing, the clamping force is applied by a spring which, for the purpose of cancelling the clamping effect, can be loaded by a pneumatic piston or bellows. Clamping is by means of one-armed crank levers which are connected by bolts to the clamping shoes in order to clamp the gearwheel ring. The one-armed crank levers are mounted on ball elements and, on movement, produce in the point of articulation of the bolt an axial displacement with respect to the clamping shoes.

As a result of the above, a clamping force is applied to the clamping shoes with the pivoting movement of the levers. The pivoting movement of the levers is produced by a guide element in which the ends of the levers engage and the guide element is mounted on a rod centrally with respect to the main gearwheel. The rod is connected to the gearwheel drive journal so as to be axially displaceable and is loaded outwardly by a compression spring. The outer end of the guide rod is guided in a rolling bearing and the bearing is mounted in a receiving element which is, in turn, connected to a pneumatic bellows.

Normally, the compression spring presses the guide element outwardly and thus, by way of the levers, locks the clamping between the gearwheel ring and the main gearwheel. On the changeover, the bellows is subjected to compressed air and displaces the guide element against the gearwheel under the load of the compression spring and in so doing releases the clamping between the gearwheel ring and the main gearwheel.

The mechanism just described has a number of disadvantages. In particular, the elements for generating the clamping are relatively complex and are mounted so as to be fixed to the cylinder. Thus they also rotate during complete operation. In addition, the force transmission is very complex. Another problem is that the bellows bears between the housing wall and the cylinder against the force of the compression spring. Consequently, on the release of the clamping an axial force is applied to the cylinder bearings and may result in a shift of the entire cylinder and hence also of the gearwheels.

The above problem is obviated in a mechanism according to DE-PS 31 27 539. As disclosed in this reference, the mechanism for clamping and releasing two gearwheels again comprises a main gearwheel with a rotatable gearwheel ring fitted thereon. Clamping is produced by way of individual bolts loaded by compression springs. The tensioning force for the compression springs is produced by a combination of two elements by means of rotary wedge surfaces. Basically, these rotary wedge surfaces each correspond to a screwthread turn. Rotation of the two elements in relation to one another thus results in a change in spacing.

One of the two elements has its rotary wedge surface facing the gearwheel and is non-rotatably connected to a tensioning plate for the gearwheel ring. The second element, which is directed with its rotary wedge surface towards the first, is disposed between the first element and the tensioning plate. The second element is also provided with a toothing on its outside. A gearwheel mounted rotatably on the cylinder journal engages this toothing.

By rotating the middle element with its rotary wedge surface it is now possible to vary the distance of the outer element with its rotary edge surface from the tensioning plate. The deflection of the compression spring on the other side of the main gearwheel is altered in these conditions and hence so is the tensioning force between the tensioning plate and the gearwheel.

To eliminate the clamping, therefore, the inner rotary wedge element is turned until the distance between the outer rotary wedge element and the tensioning plate is minimal. As a result the tensioning force of the compression spring is also minimal and the gearwheel ring can be moved on the main gearwheel. For clamping purposes the inner rotary wedge element is again moved to the highest point to produce the highest clamping force.

The arrangement of this reference obviates transmitting external forces into the arrangement comprising the gearwheel, gearwheel ring and clamp elements and the cylinder bearings. However, all the elements required for clamping and releasing the clamping again have to be mounted on the gearwheel and consequently also rotate during the entire operation. In addition there is the difficulty that a gearwheel required only for release purposes has to be mounted on the cylinder journal and accordingly also rotates continuously. The entire operation and, in particular, assembly, are rendered difficult as a result. The final and most important argument is that the drive forces required to turn this mechanism are very high since the friction between the rotary wedge surfaces is very considerable.

From DE 3,611,324 C2 there is known a further device for releasing a frictional connection of a double gearwheel consisting of main gearwheel and a concentric toothed gear ring. A tensioning disc is formed, essentially in its middle part, as an operating piston, which is disposed with a corresponding part of the main gearwheel as a hydraulic system. By energizing the hydraulic system, the tensioning force is overcome and the gear ring is released.

A disadvantage of this system is that the complete device is arranged on the cylinder dowel pin and, therefore, revolves during machine operation. Accordingly, considerable masses must be moved and also there is the danger of leakage in the hydraulic system.

In other known mechanisms, all the elements required for locking and releasing the clamping, and the drive elements provided for the purpose, are mounted on the gearwheel. The entire unit of this double gearwheel can admittedly be made relatively compact but becomes very complex and heavy. There is largely no thought of externally controlled actuation.

The problem is therefore to provide a clutch mechanism for releasing a frictional connection in a double gearwheel drive of a sheet-fed rotary press adapted to be converted from regular one-sided printing to two-sided perfecting printing wherein the clamping effect can be released without axial loading of the cylinder and its bearings and with minimum modification of the drive gearwheel. In addition, the mechanism for releasing the clamping should not have to co-rotate during operation of the press, thus greatly reducing the weight of the drive gearwheel.

OBJECTS AND SUMMARY OF THE INVENTION

According to the present invention, a clutch mechanism is provided including an actuator for releasing a frictional connection in a double gearwheel drive of a sheet-fed press wherein the double gearwheel drive comprises a main gearwheel having an annular collar and a gearwheel ring mounted concentrically on the collar and connected to the main gearwheel by a spring biased annular coupling element. The actuator is generally annular and is mounted on the press frame for axial, non-rotatable movement in substantial alignment with the annular clamping element, but is normally disposed out of contact with the main gearwheel, the gearwheel ring and the annular clamping element. An operating mechanism is provided for urging the actuator axially into engagement with the annular clamping element to overcome the spring bias and free the gearwheel ring from frictional connection with the main gearwheel.

The operating mechanism may be formed of a pair of ring elements which define a fluid pressure chamber therebetween which, when pressurized, applies the force necessary to release the clamping element. In other embodiments of the invention the operating mechanism may be cam operated or operated by an electromagnetic unit to apply the force to release the clamping element. The clutch mechanism may be disposed between the double gearwheel and the press frame or, if desired, between the double gearwheel and a press subframe disposed outboard of the double gearwheel.

A particular advantage of the present invention is the fact that the mechanism is disposed in alignment with the gearwheel, but has no contact with the double gearwheel during normal operation. To this end, the coupling consists of at least two concentric rings which are moved toward one another by means of traversing energy. During the displacement, the rings bear against elements of the double gearwheel in such a manner that clamping of the gearwheel ring is eliminated.

As noted above, the various embodiments of the invention to be hereinafter described use mechanical, hydraulic, pneumatic or electrical energy. Common to all the variants is the fact that the force required to be applied to the main gearwheel to release the clamping from the gearwheel ring is deflected inside the double gearwheel and cannot therefore affect the impression cylinder bearings. Thus there are no shifts which might result in rotary shifting of the drive, for example in the case of helical toothing. In addition, each variant is so designed that the release system does not touch the double gearwheel during normal machine operation. The most that is present on the double gearwheel itself is a release element which does not appreciably increase the mass of the double gearwheel. Given a suitable arrangement, therefore, the double gearwheel itself is completely maintenance-free and the coupling for eliminating the clamping of the double gearwheel can be fitted and removed and serviced without modifications thereto. The designs of the various alternative embodiment give other specific advantages which are explained hereinafter in the description of the exemplified embodiments These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 6 is a similar view showing a third version of the clutch mechanism with a cam drive;

FIG. 6*a* shows part of the cam of FIG. 6;

FIG. 6*b* shows a variant of FIG. 6*a;*

FIG. 6*c* shows another variant of FIG. 6*a;*

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
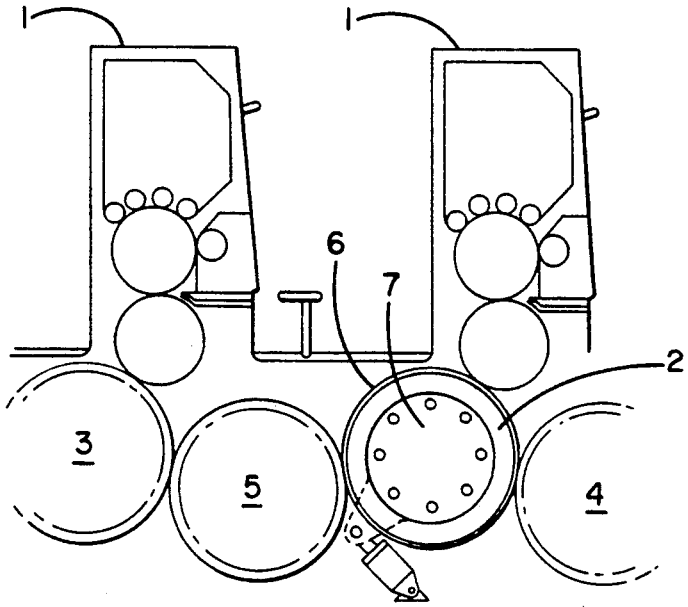
FIG. 1 is a partial somewhat schematic side view of a sheet-fed rotary press.

Turning now to the drawings, FIG. 1 is a schematic illustration of a sheet-fed rotary press. Two printing units 1 are interconnected by impression cylinders 2 and 3 and sheet transport drums 4 and 5. The printing units are driven by way of gearwheels disposed parallel to the impression cylinders 2 and 3 and sheet transport drums 4 and 5. If sheet turnover is to be carried out between the two printing units, then the relative position of the two printing units must be changed by an amount corresponding to the length of the sheet for printing. For this purpose, at the transfer point between the impression cylinder 2 and the sheet transport drum 5, there must be a relative displacement between the two printing units 1 in the transmission as well, since the sheet transport drum 5 now takes over not only the start of the sheet but also the end of the sheet from the impression cylinder 2. A double gearwheel 6 is therefore flanged on the journal of the impression cylinder 2. In this double gearwheel, a gearwheel ring is clamped to or released from a main gearwheel by means of a clutch 7.

Figure 2:
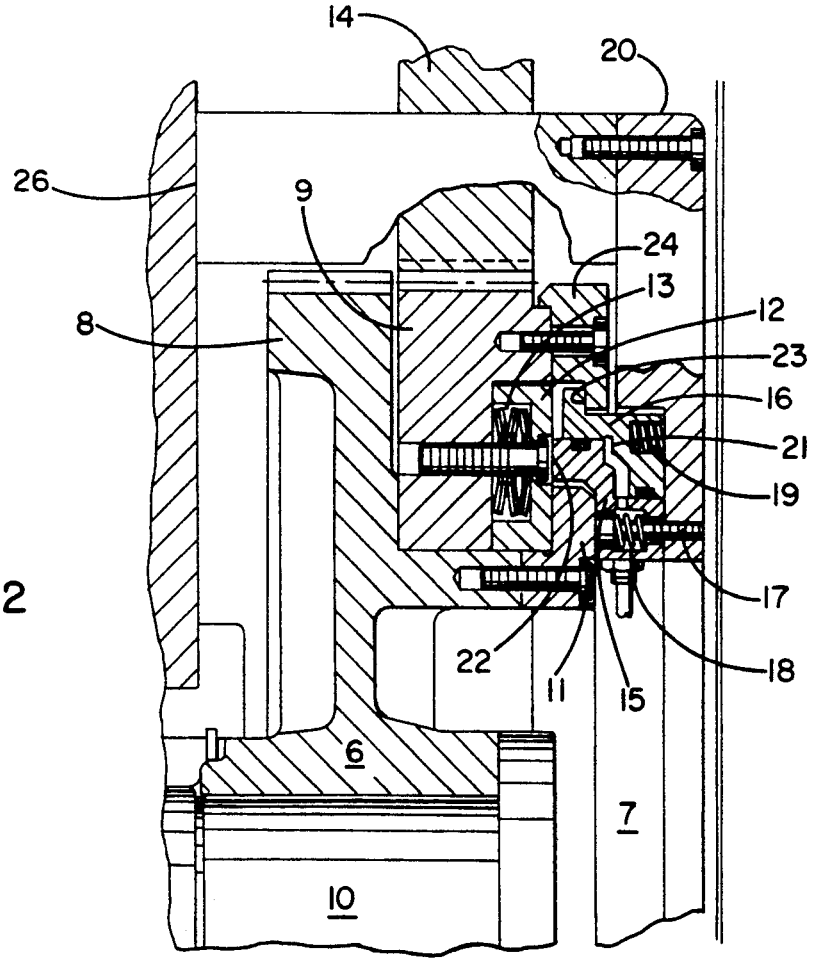
FIG. 2 is an enlarged, partial section of a clutch mechanism according to the invention.

The arrangement of a clutch 7 of this kind is shown in FIG. 2, which is a section through half a double gearwheel 6. The double gearwheel 6 consists of a main gearwheel 8 and a gearwheel ring 9. The main gearwheel 8 is connected to a cylinder journal 10. A clamping connection is made between the gearwheel ring 9 and the main gearwheel 8 by way of an annular clamp ring 11. To this end, clamping elements 12 bear between the gearwheel ring 9 and the clamp ring 11 fixed to the main gearwheel 8 and force is applied by spring assemblies 13. If there is no external load applied to the spring assemblies 13, they urge the clamping element 12 against the clamping ring 11 and hence the gearwheel ring 9 against the main gearwheel 8. The resulting frictional forces produce a reliable transmission of the drive forces. The drive forces are transmitted via a gearwheel 14 to the gearwheel ring 9 and hence also to the main gearwheel 8 and from the latter to the following drive elements. For the relative displacement when the machine is set to sheet turnover between the sheet transport elements in the sheet-fed rotary press, the clamping of the gearwheel ring 9 must be released. To this end, the clamping force of the clamping elements 12 between the clamp ring 11 and the gearwheel ring 9 must be cancelled or reduced.

In accordance with the invention, an actuator is provided for the clutch mechanism 7 for releasing the frictional engagement of the clamping ring 12. As shown in FIG. 2, it consists of an inner ring 15 and an outer ring 16. The two rings 15, 16 are part of a hydraulic or pneumatic system. This system is mounted on the inner ring 15 on retaining bolts 17, loading being applied by springs 18. The outer ring 16 is urged to the left by compression springs 19. The position of rest of the system is defined by abutment of the inner ring 15 against a carrier or subframe 20 fixed to the press frame 26. An abutment surface 21 facing the inner ring 15 is provided on one side of the outer ring 16.

To release the clamping, the outer end face 22 of the inner ring and a crank ring surface 23 of the outer ring 16 are used as operative surfaces of the system. The clamping elements 12 receive the force application from the end face 22 of the inner ring 15 and a release element 24 with an inwardly directed lip connected to the gearwheel ring 9 acts as the force application for the ring surface 23 of the outer ring 16. The position of the complete clutch 7 is defined by the carrier 20 which is rigidly connected to part of the press frame 26.

In detail, the operation of the clutch 7 will be further described in connection with FIGS. 3 and 4, as follows.

Figure 3:
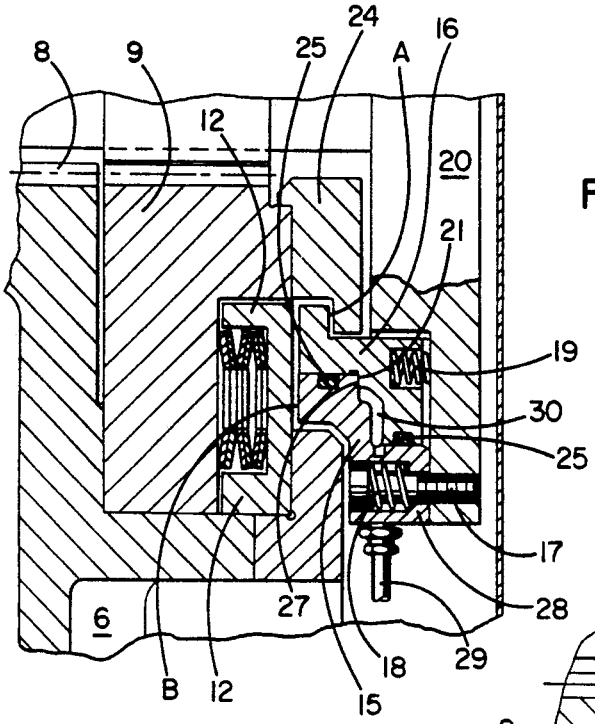
FIG. 3 is a further enlarged, partial section of the clutch mechanism in the clamped state.

FIG. 3 is a detail of FIG. 2 in which the individual parts of the clutch have been enlarged somewhat. FIG. 3 shows the clutch in the position of rest, in which it will be clear that there is a clearance A between the outer ring 16 and the release element 24. A clearance B is also present between the inner ring 15 and the clamping element 12. FIG. 3 also shows the abutment surface 21 bearing against an inner ring surface 27 of the inner ring 15. Finally, a mounting 28 of the inner ring 15 bears against the carrier 20. The spring 18 is provided for this purpose and bears against the retaining bolt 17 and urges the mounting 28 towards the carrier 20. Abutment of the outer ring 16 against the inner ring 15 is produced by the compression spring 19 which bears between the carrier 20 and the outer ring 16.

From the foregoing, it will be understood that the entire system, which is pressureless in this condition, is secured on an element fixed to the frame, namely the subframe or carrier 20, and at no point touches the double gearwheel 6 or any of its elements. In this position the sheet-fed rotary press is operated normally. To release the clamping between the gear ring 9 and the main gearwheel 8, a pressure medium is introduced via a pressure medium connection 29 into a pressure chamber 30 between the inner ring 15 and the outer ring 16. The pressure chamber 30 is sealed off by high-grade seals 25 between the outer ring 16 and the inner ring 15.

Figure 4:
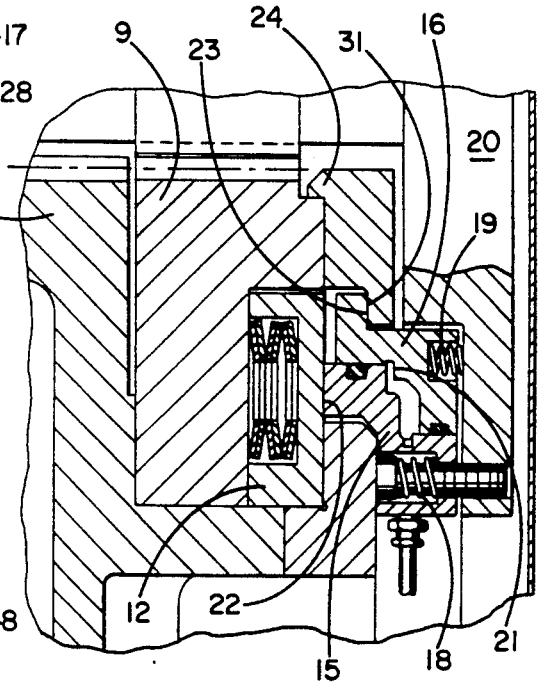
FIG. 4 is a similar view of the clutch mechanism in the disengaged state.

Pressurization of the chamber 30 results in the following events, which are shown in FIG. 4. The outer ring 16 and the inner ring 15 move apart against the force applied by the springs 18, 19. Depending on the force applied by the springs 18, 19, for example, the outer ring 16 is first moved to the right until its lip or crank surface 23 abuts against the flanged application surface 31 on the release element 24. Since it cannot now move any further, the pressure medium which continues to be supplied causes the inner ring 15 to be moved to the left. In so doing, it lifts away from its abutment against the carrier 20 against the force of the spring 18, until its end face 22 bears against the clamping element 12. In this condition the unlocking system is free of any mountings fixed to the frame, except for minor spring forces. The release forces which are applied by way of the end face 22 and the ring surface 23, bear against parts which are inside the gearwheel. The flow of force to release the clamping extends via the release element 24 and via the clamping element 12 to the gearwheel ring 9.

As the supply of pressure medium continues, the clamping is released without axial forces being transmitted to the main gearwheel 8 or its bearings. The main gearwheel 8 can be rotated relative to the gearwheel ring 9, while the latter and the transmission parts coupled thereto are held fast. An additional effect in the construction is obtained by the fact that in the region of the abutment surface 21 a pressure chamber enlargement and an enlargement of the piston surface of at least 25% are produced on the lifting of the inner ring 15 from the outer ring 16, so that there is a corresponding enlargement of the force for releasing the clamping.

On completion of the relative rotation between the transmission parts, the pressure medium system simply has to be rendered pressureless and the system returns to its original position (as shown in FIG. 3) automatically by the force of the springs 18, 19. All parts of the gearwheel are then out of contact and accordingly need not be accelerated during machine operation. Consequently, there is no need, for example, for rotary feeds for the pressure medium.

Figure 5:
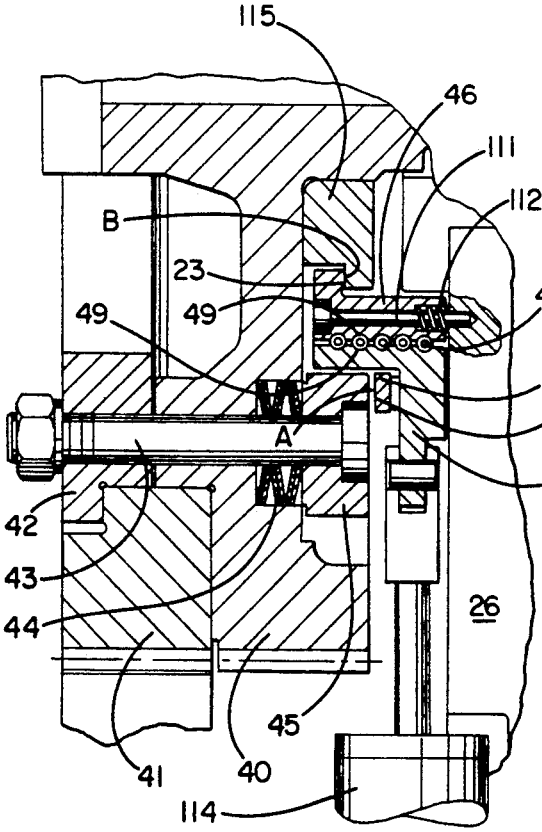
FIG. 5 is an enlarged, fragmentary sectional view showing a version of the clutch mechanism using a recirculating ball spindle.

An alternative embodiment of the invention is shown in FIG. 5, which basically uses mechanical elements. As shown here, a gearwheel ring 41 is mounted on a main gearwheel 40 and is clamped by means of a clamp ring 42 by way of tie rods 43 and spring assemblies 44. The tie rods 43 are supported in a tension element 45. The clamping force is applied by introducing a tensile force from the spring assemblies 44 into the main gearwheel 40 and, on the other hand, by way of the tensioning element 45, tie rod 43 and clamp ring 42 to the gearwheel ring 41.

To cancel out or reduce the clamping force between the gearwheel ring 41 and the main gearwheel 40 a clutch is provided after the style of a recirculating ball spindle. It consists of an inner ring 46 and an outer ring 47. The inner ring 46 is guided in the outer ring 47 by means of bearing balls 48 which run in screwthread-shaped bearing grooves 49 in the inner ring 46 and in the outer ring 47. The inner ring 46 is mounted on the machine frame 26 by means of retaining bolts 111 and is loaded by compression springs 112 to the left away from the machine frame 26. In addition, facing the main gearwheel 40 a support ring 113 mounted rotatably and axially is provided on the outer ring 47, the necessary clearance A being provided between the support ring 113 and the tensioning element 45.

To release the clamping, the outer ring 47 is rotated, for example by means of a pneumatic piston 114. In these conditions the bearing balls 48 roll in the bearing grooves 49 and shift the outer ring 47 away from the machine frame 26 and towards the tension element 45. Since the pivot angle required is relatively small, the row of bearing balls 48 can be secured against unintentional displacement at both ends by means of compression springs fixed in the bearing grooves 49. No ball return system is therefore necessary.

When the clearance A is overcome, the inner ring 46 is pulled towards the machine frame 26 against the force of the compression spring 112 and in these conditions overcomes a clearance B relative to the release element 115. The clutch is then again free of the machine frame 26 and is supported solely between elements inside the gearwheel. In this case the flow of force is between the outer ring 47, by way of the tensioning element 45 and the tie rod 43 to the clamp ring 42, and between the inner ring 46 and the release element 115 and the main gearwheel 40. It is possible for the outer ring to turn relative to the fixed main gearwheel 40, because the support ring 113 is mounted for rotation relative to the abutment surface on the outer ring 47.

To re-clamp the gearwheel ring 41 on the main gearwheel 40, the outer ring 47 is turned back by means of the pneumatic piston 114 and returned to its starting position by the force of the compression spring 112. It is then again free of any contact with any gearwheel elements. Here again, the release element 115 is the only required additional means mounted directly on the double gearwheel 40, 41.

Another embodiment of the release mechanism of the present invention is shown in FIG. 6. Here, instead of a recirculating ball spindle, a cam drive is used to produce the operative movement. Similar to the illustration in FIG. 5, a release element 51 is fixed on the main gearwheel 50. The clamping is transmitted by tie rod 52 and a tensioning element 53 to the clamp ring and the gearwheel ring (neither of which is shown here).

In the embodiment illustrated in FIG. 6, the clutch is constructed from three rings, the outer ring of the other embodiments hereinbefore being divided into two rings. An inner ring 54 is again fixed on the machine frame 26 so as to be displaceable and has a flat contact surface 56. The outer ring 55, disposed opposite the flat contact surface 56, is carried on the inner ring 54 by tension springs, and has cams 63 in its surface. A number of such cams 63 are disposed similarly at the periphery of the outer ring 55. An adjusting ring 57 is provided as the third ring between the inner ring 54 and the outer ring 55. Cam followers 58, 59 are disposed at the inner periphery of adjusting ring 57 so that the cam followers 58 run on the cams 63 of the outer ring 55 and the cam followers 59 run on the flat contact surface 56 of the inner ring 54. The number of cam rollers 58, 59 provided corresponds to the number of cams 63 in the outer ring.

In the position of rest, the inner ring 54, which is guided for axial displacement on retaining bolts 60, is held out of contact with the machine frame 26 by compression springs 61 and the distance between the outer ring 55 and the inner ring 54 being minimal, since the cam followers 58 are on the low point of the cams 63. The unit consisting of the outer ring 55, adjusting ring 57 and inner ring 54 is held together by the above-mentioned tension springs (which are shown only in FIG. 6*a*), so that the cam followers 58, 59 are always in contact with their co-acting surfaces 56, 63.

FIG. 6*a* shows the relative arrangement of the cams 63, flat contact surface 56 and cam followers 58, 59 on the adjusting ring 57. On turning of the latter at its pivot arm 62, the cam followers 58, 59 run on the flat contact surface or the cams 63 opposite the same and, in so doing first shifts the outer ring 55 outward until it comes into abutment with the tensioning element 53. The inner ring 54 is then moved inward against the force of the compression spring 61 until it abuts the release element 51. Only then is the force operative to reduce the clamping between the clamping element and the gearwheel ring and the main gearwheel 50. In these conditions no movement is required at the outer ring since the adjustment movement is fully taken by the adjusting ring 57 which, of course, has bearing elements in the form of the cam followers 58, 59 relatively to the two rings 54, 55.

FIG. 6*b* shows a simplified version of the embodiment of FIG. 6. Instead of the arrangement of cam followers, guide slots 64 are formed in the adjusting ring 57 and pairs of support rollers 65 are inserted in them. The rollers 65 are disposed one above the other, one resting on the flat contact surface 56 and the other on a cam 63 and both being in contact in the center. Here again the two rings 54, 55 are pulled towards one another by springs 69, so that the support rollers 65 are held in their guide slots 64. In this way the arrangement can be made even more compact and, in particular, very much simpler, while a larger number of support points is also possible at the periphery of the clutch.

FIG. 6c shows another simplified version of the embodiment according to FIG. 6. Instead of two cam followers, only one cam follower 66 is now provided for each support point on the adjusting ring 57. The originally resiliently connected rings 54, 55 are combined to form a rigid ring 67. The cam is now in the form of a groove 68 in the ring 67. In this case, a mounting may be necessary between the moving adjusting ring 57 and its abutment surface on part of the main gearwheel 50, as shown in FIG. 5 between the outer ring 47 and the tensioning element 45.

Figure 7:
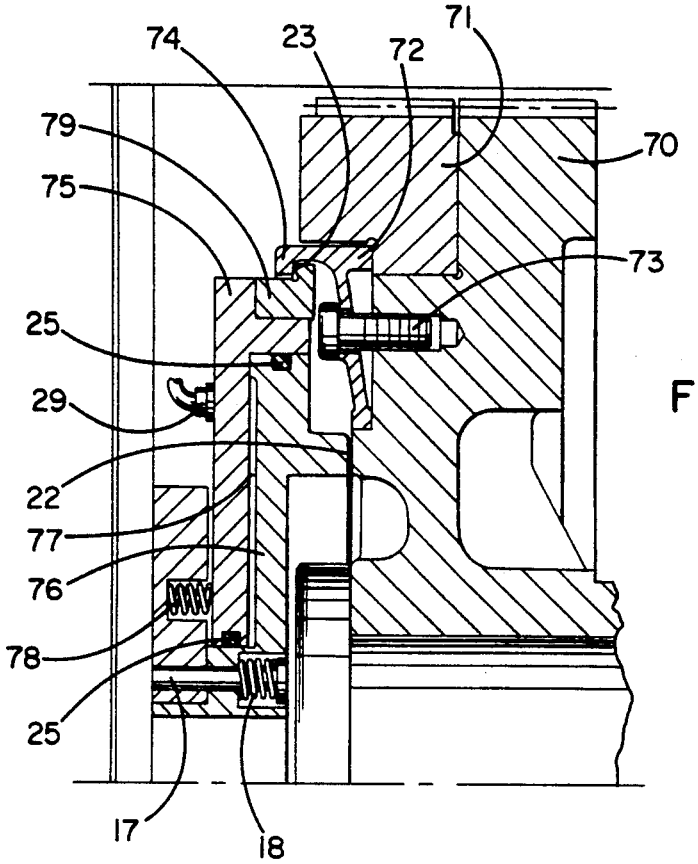
FIG. 7 is an enlarged, fragmentary sectional view of another version of the clutch mechanism with a pneumatic piston actuator.

Another embodiment of the invention is shown in FIG. 7. Here the gearwheel ring 71 is disposed directly on the main gearwheel 70. Clamping is by way of a conical tensioning element 72. The outside of the latter has a peripheral grip edge 74 and is clamped against the main gearwheel 70 by tensioning screws 73 at its conically extending hub. The outer ring 75 and the inner ring 76 of the actuator are each part of a pneumatic piston.

For release purposes, the pressure chamber 77 is subjected to compressed air as a result of which the two rings 75, 76 are pushed apart against the force of compression springs 78. In these conditions the inner ring 76 is supported on the hub of the main gearwheel 70 and the outer ring 75 engages the grip edge 74 by a grip ring 79 and in so doing pulls the clamp element 72 out somewhat so that the clamping between the main gearwheel 70 and the gearwheel ring 71 is released. Again, a large number of parts can be dispensed with this version of the invention. In addition, an effect becomes apparent here which can also be observed in the other versions.

When the clamping is released, the main gearwheel 70 is automatically secured against turning by the fact that the coupling mechanism is supported between the gearwheel hub and the tensioning element 72. Thus no brake is now required and the sheet-fed press can also be turned by the drive motor on the side towards the feed unit, since the motor brake is no longer required to block one of the machine sections.

Figure 8:
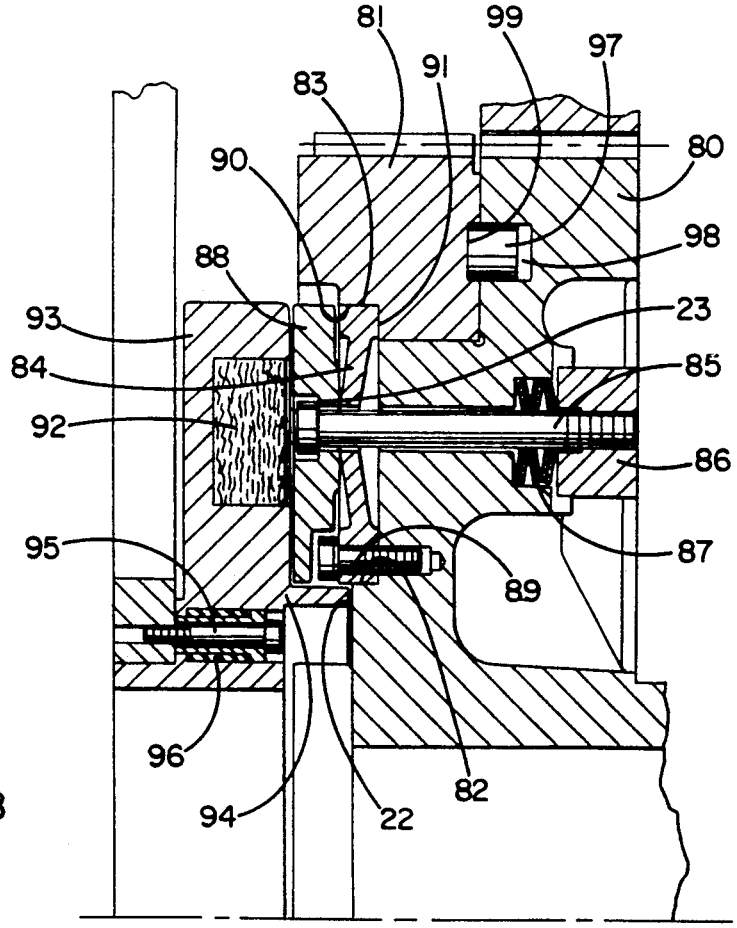
FIG. 8 is a similar view of another version of the clutch mechanism with an electromagnetic operator.

FIG. 8 shows another embodiment of the invention wherein clamping is achieved by means of conical tensioning elements. A gearwheel ring 81 is fitted to a main gearwheel 80. A conically shaped annular tensioning element 84 is disposed between a collar 82 on the main gearwheel 80 and a collar 83 on the gearwheel ring 81. The tensioning element 84 acts like a double Belleville washer. Tie rods 85 extend through the central circle of the tensioning element and are supported on the opposite side on a spring assembly 87 at the main gearwheel 80 via a retaining element 86. The tie rods 85 are in turn held in a bearing plate 88 and are supported via the latter on the annular rise of the tensioning element 84. As a result of the tensioning force of the spring assembly 87, by way of the bearing plate 88, the tensioning element 84 is forced apart or radially expanded by pressure on its center-line. In these conditions it is supported on the one hand via its inner surface 89 and its outer surface 90 on the collar 82 of the main gearwheel 80 and on the collar 83 of the gearwheel ring 81, while on the other hand it is pressed axially with its end face 91 against the surface at right angles to the collar 83.

As a result of the foregoing, the friction surface for generating high clamping force between the gearwheel ring 81 and the main gearwheel 80 is considerably increased. In this way, the retaining force of the entire system is also improved, so that reduced spring forces can be used. In this case, it is also possible to release the coupling system in a different way, by using an electromagnet 92 which acts on the bearing plate 88 and hence on the tie rods 85. The operating principle is equivalent to the versions already described. The electromagnet 92 is disposed in a ring 93 and has a concentric annular projection 94. It is also axially displaceable at the machine frame 26 by way of retaining bolts 95 with loading being provided by a compression spring 96.

When the electromagnet 92 is switched on, it will first move against the force of the compression spring 96 until its projection 94 abuts the hub of the main gearwheel 80. It then pulls up the bearing plate 88 and hence, by way of the tie rods 85, the retaining element 86, so that the spring force acting on the tensioning element 84 is reduced. As a result, the tensioning element 84 will on the one hand contract radially so that the clamping forces on the outer and inner surfaces 90 and 89 respectively are reduced. On the other hand, as a result of the force of the spring assembly 87 being relieved, the axially acting clamping force on the end faces 91 is also reduced. The gearwheel ring 81 is thus released to such an extent that it is possible for relative movement in relation to the main gearwheel 80. Normally, the arrangement of the double gearwheel or of its clamping elements is free of the electromagnet 92. Moreover, no additional mechanical elements are required for operating the release mechanism.

A detent bolt 97 may be provided between the gearwheel ring 81 and the main gearwheel 80 for positional indexing. It is mounted resiliently in a bore 98 on the main gearwheel 80. An index bore 99 is provided in the gearwheel ring 81 for matching purposes for the single-sided printing position. To change over to perfecting the detent bolt 97 has to be pulled. It engages automatically on resetting. The operation can be automated in respect of actuation and monitoring.

Figure 9:
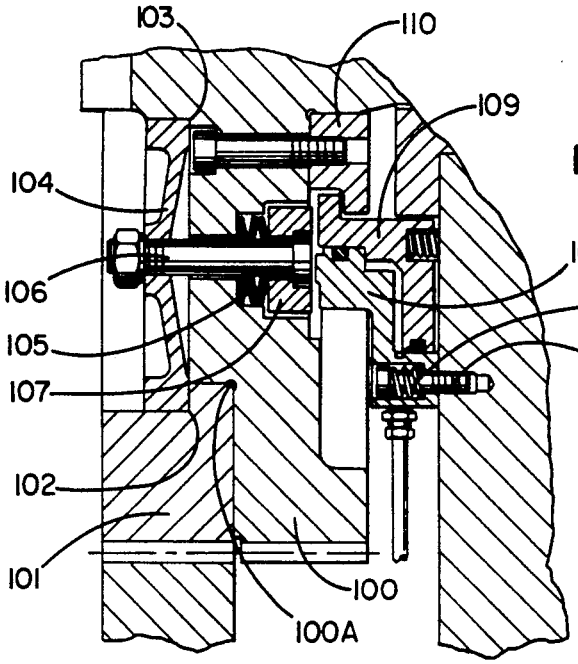
FIG. 9 is a partial sectional view of a clutch mechanism with a frictional force boosting clamp ring.

In FIG. 9, the clamping embodiment described above in connection with FIG. 8 is constructed in accordance with the operation of original embodiments (FIGS. 2 to 4), release being effected by means of an annular hydraulic or pneumatic actuator. At the main gearwheel 100 the gearwheel ring 101 is fitted on an outer collar 100*a*, the gearwheel ring 101 additionally having a collar 102 and the main gearwheel 100 an inner collar 103. An annular tensioning element 104 with a conical annular wall is fitted so as to bear against the collars 102, 103. The tensioning element 104 is tensioned by spring assemblies 105, tie rods 106 and a retaining element 107 so that it bears by its inner and outer surfaces against the collars 102, 103 and by its inner end face against the surfaces of the gearwheel 100 and gearwheel ring 101 at right angles thereto and thus clamps the gearwheel ring 101.

Release is effected by the supply of pressure medium to a pressure chamber bounded by an inner ring 108 and an outer ring 109. In these conditions the outer ring 109 bears by its crank end on a flanged release element 110 fixed on the main gearwheel 100 and the inner ring 108 bears on the retaining element 107 so that the prestressing of the spring assembly on the tensioning element 104 is reduced and the gearwheel ring 101 can be turned. Given a relatively constant ring piston area, less pressure energy is required than previously as a result of the force-intensifying effect of the enlarged friction surface at the tensioning element 104.

Figure 10:
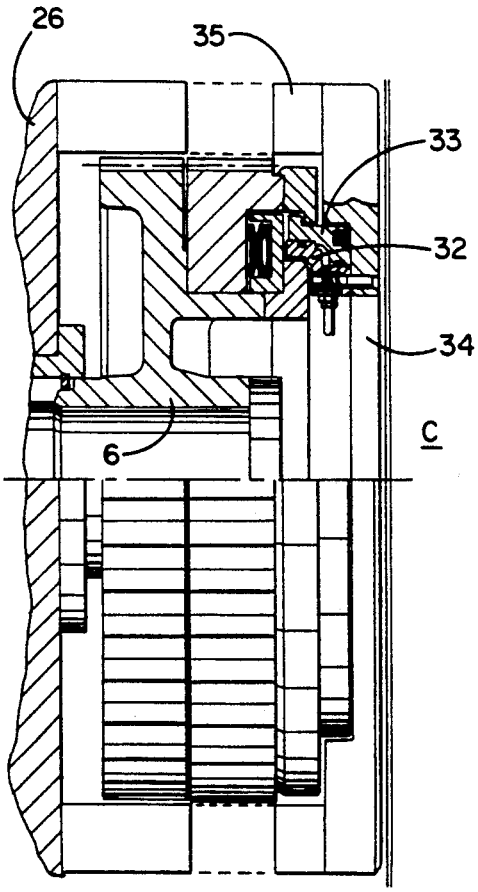
FIG. 10 is a general view, partially in section, of a double gearwheel with the clutch mechanism mounted on a subframe of the press.

In FIG. 10 the arrangement of a complete clutch is shown as a front attachment to the double gearwheel 6. For this purpose, an inner ring 32 and an outer ring 33 are mounted on a subframe crossmember 34 which is held on the machine frame 26 on two or more supports 35. In this way the clutch can be actuated and serviced at all times from the outside C of the machine.

Figure 11:
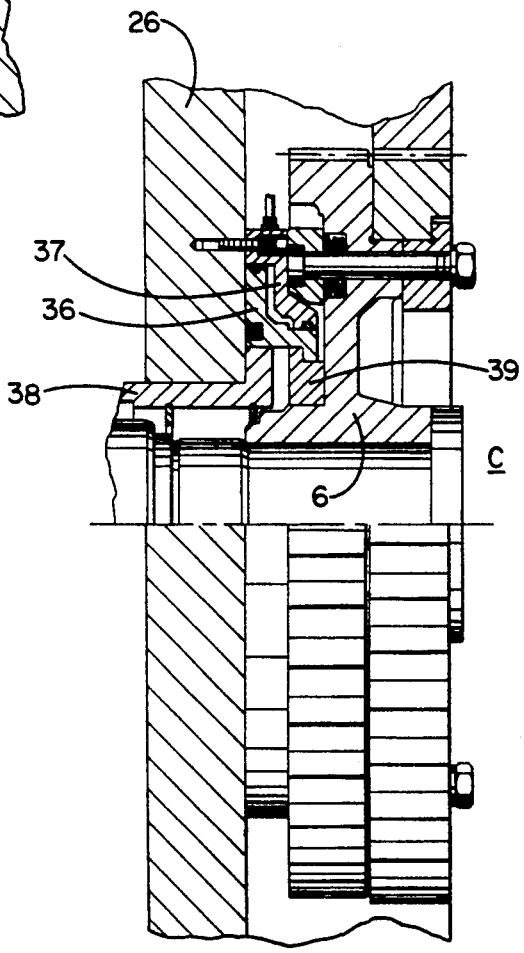
FIG. 11 is a similar view which shows a clutch mechanism mounted directly on the press frame.

In FIG. 11, the entire arrangement is disposed directly on the machine frame 26 behind the double gearwheel. The inner ring 36 and the outer ring 37 directly enclose the journal bearing 38 of an impression cylinder. A release element 39 is fixed on the hub of the double gearwheel 6. Thus a very space-saving construction is obtained from the outside C. Admittedly this renders operation and access difficult for any maintenance work, but in view of the simplicity of the mechanism no particular problems are to be expected during operation.

There are also a number of possibilities for adapting the energy supply to the optimum energy in the press. For example, the pneumatic energy normally available at the press, which is at a relatively low pressure level, can be utilized by force boosting means, e.g. pressure boosters. This has already been indicated in the version with the conical tensioning elements. Finally, the arrangement of release elements, retaining elements, clamp rings and spring assemblies is open to such a wide variety of options that they cannot all be shown here, although the variants illustrated are indicative of such further possibilities.

I claim as my invention:

1. A clutch mechanism for releasing a frictional connection in a double gearwheel drive of a sheet-fed rotary press adapted to be converted from regular one-sided printing to two-sided perfecting printing wherein said press includes a frame and said double gearwheel drive comprises a main gearwheel having an annular collar and a gearwheel ring mounted concentrically on said collar and frictionally connected to said main gearwheel by a spring biased annular clamping element, comprising, in combination, an annular actuator mounted on said press frame for axial, non-rotatable movement in substantial alignment with said annular clamping element, said actuator being normally disposed out of contact with said main gearwheel, said gearwheel ring and said annular clamping element, and means for selectively engaging said actuator with said clamping element and causing relative axial displacement thereof to overcome said spring bias and free said gearwheel ring from said frictional connection with said main gearwheel.

2. A clutch mechanism as defined in claim 1 wherein said annular actuator comprises a two-part release and clamping mechanism having first and second ring elements displaceable toward and away from one another substantially axially relative to said double gearwheel.

3. A clutch mechanism as defined in claim 2 wherein said double gearwheel has a shaft journalled in a bearing mounted in said press frame, and said annular actuator is disposed concentrically around said bearing between said double gearwheel and said press frame.

4. A clutch mechanism as defined in claim 2 wherein said double gearwheel has a shaft journalled in a bearing mounted in said press frame, a subframe is secured to said press frame outboard of said double gearwheel, and said annular actuator is disposed between said double gearwheel and said press subframe.

5. A clutch mechanism as defined in claim 2 wherein said first ring element is non-rotatably secured to said press frame for limited axial displacement, spring means for biasing said first ring element substantially axially in the direction of said double gearwheel, and said second ring element is mounted for limited axial displacement relative to said first ring element.

6. A clutch mechanism as defined in claim 5 wherein said gearwheel ring has a flange element with a radially inwardly directed annular lip secured thereto, said first ring element has a force application surface in substantial alignment with said clamping element, and said second ring element has an oppositely directed locking surface in substantial alignment and engageable with said annular lip.

7. A clutch mechanism as defined in claim 6 wherein said first and second ring elements define an annular fluid pressure chamber therebetween, means for biasing said first and second ring elements toward one another, and means for supplying fluid pressure to said chamber for urging said first and second ring elements apart so that said force application surface of said first ring element engages said clamping element and said locking surface of said second ring element engages said annular lip of said flange element.

8. A clutch mechanism as defined in claim 7 wherein sealing elements are provided between said first and second ring elements to seal said annular fluid pressure chamber.

9. A clutch mechanism as defined in claim 7 wherein said first and second ring elements are formed with facing stepped configurations so that when fluid pressure is supplied to said chamber and said first and second ring elements from one another an effective piston area of said chamber is increased by at least 25%.

10. A clutch mechanism as defined in claim 5 wherein said second ring element is rotatably mounted relative to said first ring element, transmission means are interposed between said first and second ring elements for producing relative axial displacement therebetween when said second ring element is rotated, and means for rotating said second ring element.

11. A clutch mechanism as defined in claim 10 wherein said transmission means includes rolling elements interposed between said first and second ring elements for producing relative axial displacement therebetween.

12. A clutch mechanism as defined in claim 11 wherein said rolling elements are retained as part of a recirculating ball spindle transmission between said first and second ring elements.

13. A clutch mechanism as defined in claim 12 wherein said second ring element is provided at its inner periphery with a bearing groove of semi-circular cross-section extending in the form of a screwthread and said first ring element is provided with a similar corresponding bearing groove at the outer periphery thereof, a row of bearing balls is disposed in the screwthread cavity defined between the bearing grooves, and said row of bearing balls is supported at both ends by springs anchored in the bearing grooves.

14. A clutch mechanism as defined in claim 12 including a support ring rotatable on an axial bearing is disposed on said first ring element.

15. A mechanism according to claim 10 including an adjusting ring interposed between said first and second ring elements, a plurality of cam followers uniformly distributed about the periphery of said adjusting ring, cams engageable with said cam followers disposed on at least one of said first and second ring elements, and means for rotating said adjusting ring relative to said first and second ring elements.

16. A clutch mechanism according to claim 15 wherein said cam followers are disposed in two axially offset planes with the axis aligned radially in relation to said adjusting ring, said cam followers in one plane cooperating with said first ring element and said cam followers in the other plane cooperating with said second ring element, the corresponding co-acting surface of said second ring being flat and the surface of said first ring being provided with cams in the region of said cam followers, and spring means for biasing said first and second ring elements toward one another and into engagement with said cam followers.

17. A clutch mechanism as defined in claim 15 wherein said cam followers each comprise a pair of loose support rollers disposed in guide slots provided radially on said adjusting ring so that each support roller cooperates with one of the first and second ring elements and the two support rollers roll on one another, and spring means for biasing said first and second ring elements toward one another and into engagement with said cam followers.

18. A clutch mechanism according to claim 11 including an adjusting ring and cam followers disposed on the outer periphery of the adjusting ring and said transmission means comprises grooved cams at the inner periphery of said second ring element.

19. A clutch mechanism as defined in claim 1 wherein said actuator includes an annular electromagnet disposed in substantially axial alignment with said clamping element, and a bearing plate mounted on said double gearwheel in conjunction with said clamping element, said electromagnet cooperating with said bearing plate to release said clamping element.

20. A clutch mechanism according to claim 19 wherein said clamping element comprises an annular, peripherally expandable tensioning element disposed radially between portions of the main gearwheel and the gearwheel ring, said tensioning element having axial and radial friction surfaces engageable with said main gearwheel and said gearwheel ring, and means including a spring assembly and tie rods for prestressing said tensioning element.

* * * * *